US007134400B2

(12) United States Patent
Blank

(10) Patent No.: US 7,134,400 B2
(45) **Date of Patent: *Nov. 14, 2006**

(54) STOWABLE RAMP FOR A PONTOON BOAT

(76) Inventor: Charles L. Blank, 7014 Pasadena Ave., Dallas, TX (US) 75214

( * ) Notice: Subject to any disclaimer, the term of this patent is extended or adjusted under 35 U.S.C. 154(b) by 0 days.

This patent is subject to a terminal disclaimer.

(21) Appl. No.: 11/405,253

(22) Filed: Apr. 17, 2006

(65) Prior Publication Data

US 2006/0180071 A1 Aug. 17, 2006

Related U.S. Application Data

(63) Continuation of application No. 10/686,419, filed on Oct. 15, 2003, now Pat. No. 7,028,632.

(51) Int. Cl.
*B63B 17/00* (2006.01)

(52) U.S. Cl. ..... 114/362

(58) Field of Classification Search ..... 114/61.1, 114/362

See application file for complete search history.

(56) References Cited

U.S. PATENT DOCUMENTS 6,748,895 B1 * 6/2004 Besenzoni ..... 114/362
6,868,799 B1 * 3/2005 Wright ..... 114/343
7,028,632 B1 * 4/2006 Blank ..... 114/362

* cited by examiner

*Primary Examiner*—Stephen Avila
(74) *Attorney, Agent, or Firm*—Patton Boggs LLP

(57) ABSTRACT

A ramp assembly for a pontoon boat includes a pair of ramp support members, at least one of a roller and a guide bar, and a ramp. The ramp support members are positioned beneath a deck of the pontoon boat and include a vertically-oriented portion. The at least one of the roller and the guide bar is mounted to the vertically-oriented portion of each ramp support member. The ramp includes a pair of side rails, each side rail positioned on a side of a ramp walkway, the side rails each having an upper rail member and a lower rail member joined by a web and forming an outboard pocket. The ramp is received between the ramp support members such that the at least one of the roller and the guide bar mounted to each vertically-oriented portion is positioned in the outboard pocket of each side rail.

20 Claims, 9 Drawing Sheets

STOWABLE RAMP FOR A PONTOON BOAT

CROSS-REFERENCE TO RELATED APPLICATIONS

This application is a continuation of and claims priority to U.S. patent application Ser. No. 10/686,419, filed Oct. 15, 2003, now U.S. Pat. No. 7,028,632, and said application is hereby incorporated by reference.

BACKGROUND OF THE INVENTION

1. Field of the Invention

This invention relates generally to pontoon boats and more particularly to a stowable ramp for a pontoon boat that is selectively positionable on any side of the pontoon boat.

2. Description of Related Art

Recreational boating has become increasingly popular in recent years. While interest in ski boats and fishing boats remains high, many people are interested in boats for cruising and relaxation. Pontoon boats are an inexpensive alternative to yachts, cabin cruisers, and other luxury pleasure boats. A pontoon boat has a large deck supported by at least two pontoons. A motor and steering system are typically attached to the pontoon boat to provide locomotion and control. Because of the large, open surface provided by the deck, pontoon boats are ideally suited for large numbers of people. The boats provide plenty of space for lounging or grilling food.

Because the deck of a pontoon boat is mounted relatively high above the water line on a pair of pontoons, it is sometimes difficult for passengers on board to exit the boat. Entry and exit without the assistance of an adjacent boat dock is difficult, if not impossible. It is often desirable for a boat operator to be able to beach a pontoon boat on shore; however, only those passengers than can jump or pull themselves onto the deck of the boat will be able to exit or board.

There have been some ramps developed for use with pontoon boats. However, these ramps are typically overly complicated and heavy. These ramps typically have many moving parts, which cause excessive movement and noise beneath the deck of the boat as the boat is underway or when the boat experiences rocking due to wave motion. The bulkiness of some ramps causes the ramps to extend below the deck far enough that the ramp impedes the stream of water displaced by the pontoons. This can increase the drag on the pontoon boat as it moves through the water.

Existing ramps are fixed relative to that portion of the boat accessed by the ramp. More specifically, existing ramps will only allow access to one side of a vessel. This is adequate but does not allow flexibility in docking the boat. For example, a boat operator docking a boat on a beach will typically beach the bow first. In this instance, it would be useful if the ramp allowed access to the bow of the boat. If the boat were docked adjacent to a boat dock, pier, or other boat, it would be useful if the ramp allowed access to either the port or starboard side of the boat.

A need therefore exists for an improved ramp for a pontoon boat that is easily stowed beneath the deck of the boat, yet does not increase the drag characteristics of the boat. A need further exists for a ramp that is simple and lightweight in design, thereby allowing a single person to easily extend and stow the ramp. The ramp should also preferably be secured to the pontoon boat in such a way that it does not move or create excessive noise when the pontoon boat is underway or when the boat experiences movement caused by waves. Finally, a need exists for a ramp that is easily positionable at any one of several stations on a boat for allowing passengers to board from any side of the boat.

BRIEF SUMMARY OF THE INVENTION

The problems presented by traditional pontoon boat ramps are solved by the present invention. A stowable ramp assembly having a pair of ramp support members, at least one of a roller and a guide bar, and a ramp is provided. The ramp support members are attached beneath a deck of the pontoon boat, and each ramp support member includes a vertically-oriented portion. At least one of the at least one of the roller and the guide bar is attached to each vertically-oriented portion of the ramp support member. The ramp includes a pair of side rails that each include an upper rail member and a lower rail member joined by a web. The ramp is received by the ramp support members such that each of the at least one of the roller and the guide bar is positioned between the upper rail member and the lower rail member of the side rail.

The ramp is selectively positionable along any side of the pontoon boat. Preferably, a pair of ramp hangers is attached to the deck at each of the bow, port side, and starboard side of the boat. When the ramp is removed from the ramp support members, the ramp can be hung from the ramp hangers by inserting endcap legs on an inboard end of the ramp into slots on the ramp hangers. Preferably, the ramp hangers are upper ramp hangers that are attached to the deck of the boat and provides a smooth, non-stepped transition between the deck and the walkway surface of the ramp. Alternatively, the ramp hanger could be a lower ramp hanger that is attached to various support structures beneath the deck of the boat.

Several accessories are provided with the ramp assembly to facilitate use of the ramp. A plank shoe is provided that includes a heel, a toe, and an inclined surface. The plank shoe is pivotally connected to an outboard end of the ramp when the ramp is placed in an extended position. The inclined surface provides a smooth transition between the walkway surface of the ramp and an anchor surface on which the outboard end of the ramp rests. The plank shoe is especially helpful for elderly and handicapped passengers because it eliminates a step that could cause a person to trip.

A collapsible railing is also provided to aid passengers boarding the exiting the boat. The collapsible railing includes at least one hand railing pivotally connected to a plurality of support legs. Each support leg is received by a railing hole disposed in the ramp when the collapsible railing is placed in an assembled position. In a collapsed position, the support legs are removed from the railing holes, and the support legs are pivoted to be adjacent to the hand railing for storage.

Other objects, features, and advantages of the present invention will become apparent with reference to the drawings and detailed description that follow.

DETAILED DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
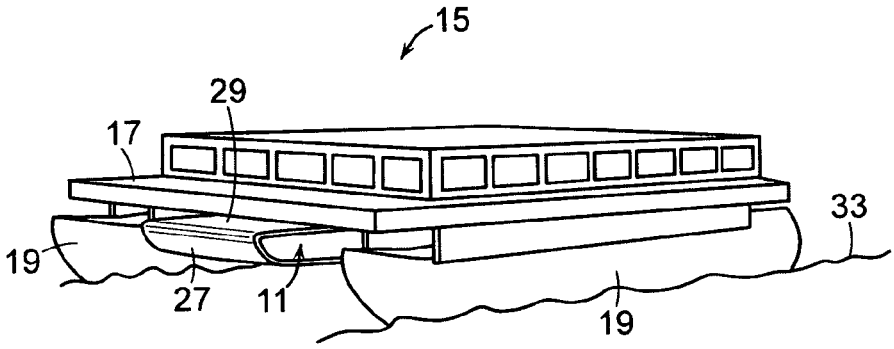
FIG. 1 depicts a perspective view of a pontoon boat having a deck, two pontoons, and a stowable ramp according to the present invention.
Figure 2A:
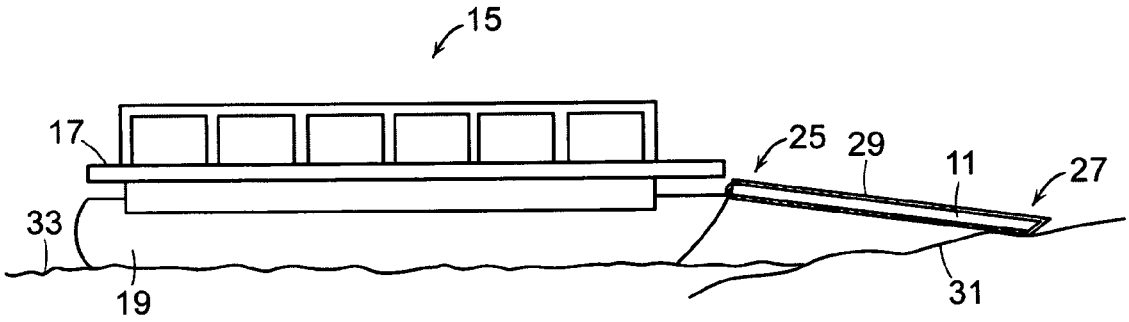
FIG. 2A illustrates a perspective view of the pontoon boat of FIG. 1, the stowable ramp being shown in an extended position resting on an anchor surface below the deck of the pontoon boat.
Figure 2B:
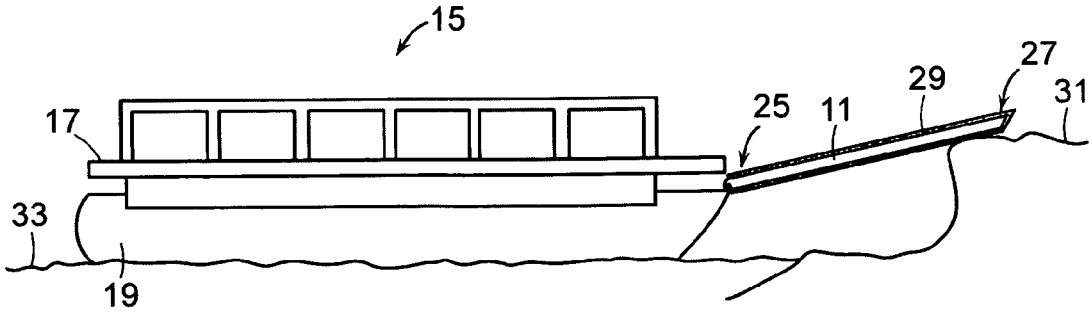
FIG. 2B depicts a perspective view of the pontoon boat of FIG. 1, the stowable ramp being shown in an extended position resting on an anchor surface above the deck of the pontoon boat.

Referring to FIGS. 1, 2A, and 2B, a stowable ramp 11 according to the present invention is provided for a pontoon boat 15 having a deck 17 supported by at least two pontoons 19. Ramp 11 includes an inboard end 25 and an outboard end 27 and has a walkway surface 29 that provides ingress and egress for users of the pontoon boat 15. The ramp is capable of being placed in a stowed position (shown in FIG. 1) or an extended position (shown in FIGS. 2A and 2B). In the extended position, the inboard end 25 of the ramp 11 is hingedly connected to the pontoon boat 15 and is supported at the outboard end 27 by an anchor surface 31. The anchor surface 31 may be above, below, or level with the deck 17 and may be any type of shoreline including without limitation sand, clay, mud, rock, or vegetation. Alternatively, the anchor surface could be a man-made structure such as a jetty, boat dock, or even another boat. As illustrated in FIGS. 1, 2A, and 2B, the most likely use of the ramp 11 would be when the pontoon boat 15 is floating on a body of water 33, but the ramp 11 can also be extended and used when the pontoon boat 15 is pulled onto shore or is in dry dock.

Figure 3A:
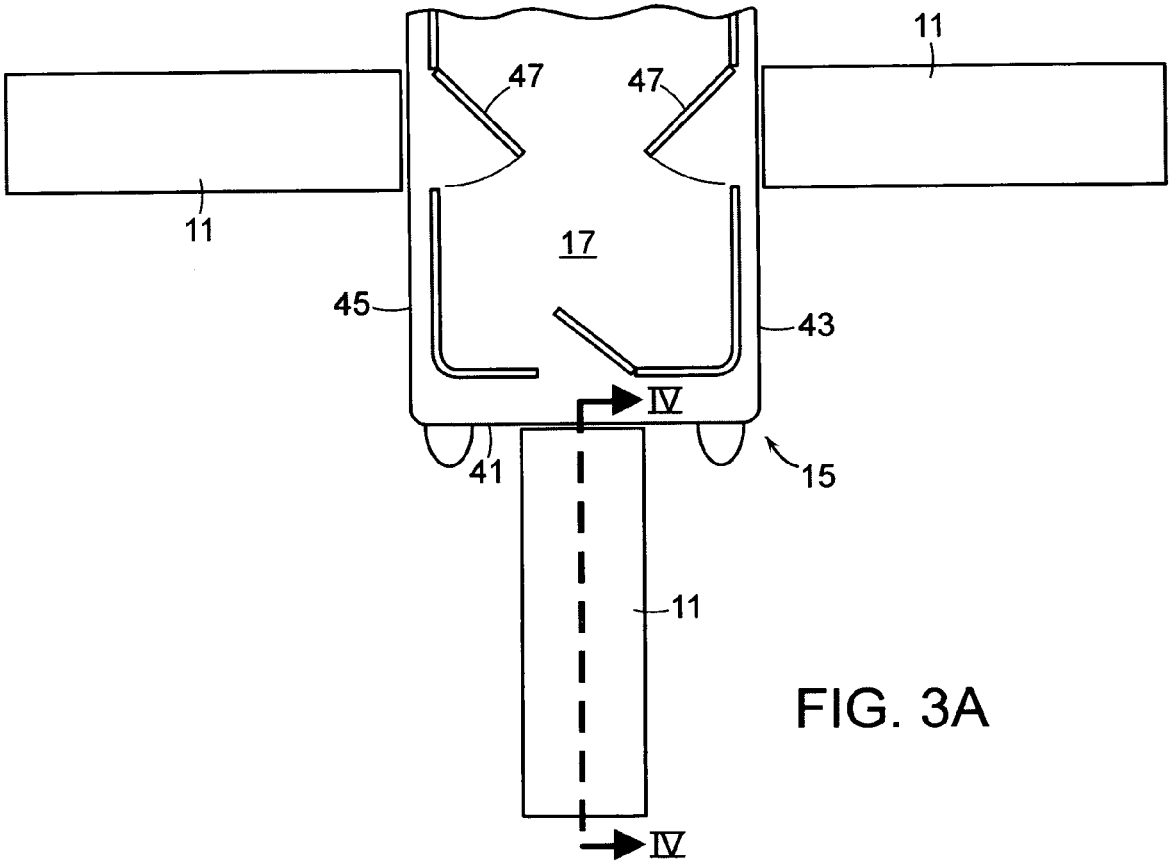
FIG. 3A illustrates a top view of the pontoon boat and stowable ramp of FIG. 1, the stowable ramp being shown in several alternative positions, an extended position on the bow of the pontoon boat, an extended position at the port side of the pontoon boat, and an extended position on the starboard side of the pontoon boat.
Figure 3B:
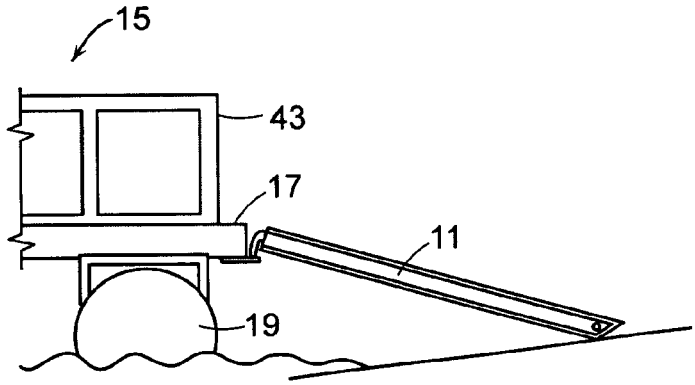
FIG. 3B depicts a front view of the pontoon boat and stowable ramp of FIG. 1, the stowable ramp being shown in an extended position on the port side of the pontoon boat.

Referring to FIGS. 3A and 3B, ramp 11 can be selectively positioned at different locations on the pontoon boat 15. In addition to allowing attachment at the bow 41 of the boat (as shown in FIGS. 1, 2A, and 2B), the ramp 11 could be positioned at either the port side 43 or starboard side 45 of the pontoon boat. A skilled artisan will recognize that many pontoon boats have entry gates 47 located on the side railings, which would allow ingress and egress for passengers using the ramp on either the port 43 or starboard 45.

Figure 4A:
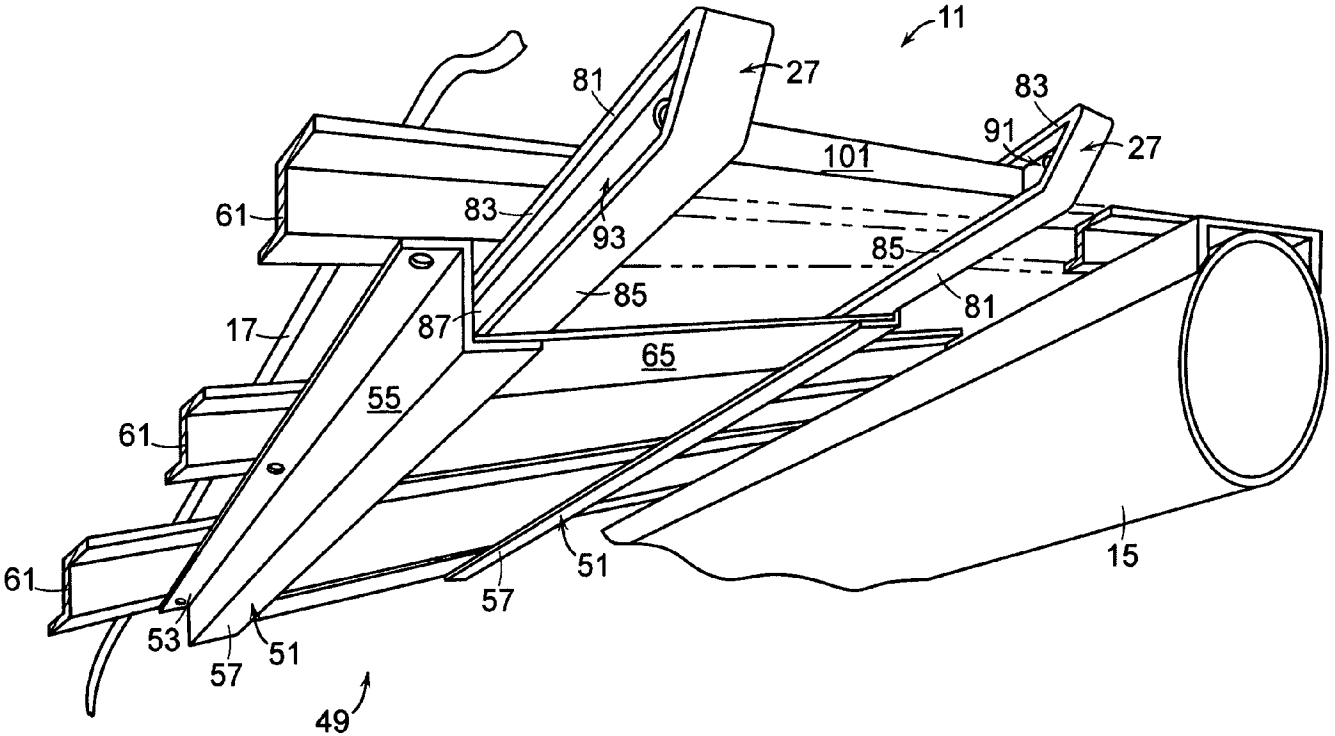
FIG. 4A illustrates a perspective view of the pontoon boat and stowable ramp of FIG. 1, the ramp being shown supported by a pair of ramp support members attached beneath the deck of the pontoon boat.
Figure 5A:
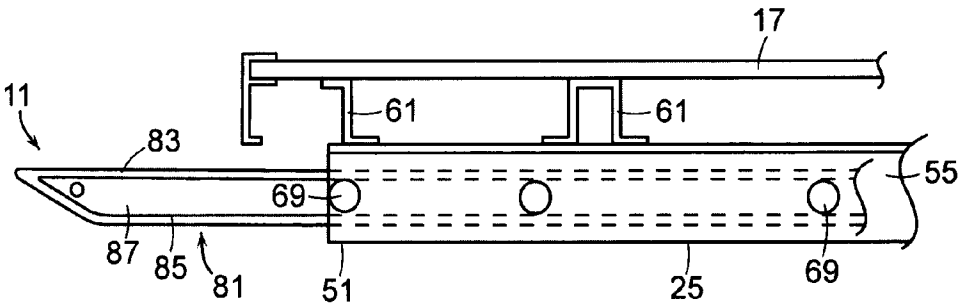
FIG. 5A depicts a side view of the ramp support members of FIG. 4A, the ramp being supported by rollers rotatably positioned on the ramp support members.

Referring to FIGS. 4A and 5A, a ramp assembly 49 according to the present invention includes a pair of ramp support members 51 for receiving ramp 11. Ramp support members 51 are preferably z-shaped extrusions that include an upper portion 53, a vertically-oriented portion 55, and a lower portion 57. The upper portion 53 of each ramp support member is rigidly attached to a plurality of deck supports 61 positioned beneath deck 17. The ramp support members 51 is turned toward the other ramp support member 51. A plurality of lateral stabilizers 65 is rigidly attached between the lower portions 57 and between the upper portions 53 to provide additional rigidity to the ramp support members 51. A plurality of rollers 69 are rotatably mounted to each vertically-oriented portion 55 of the ramp support members 51.

Figure 4B:
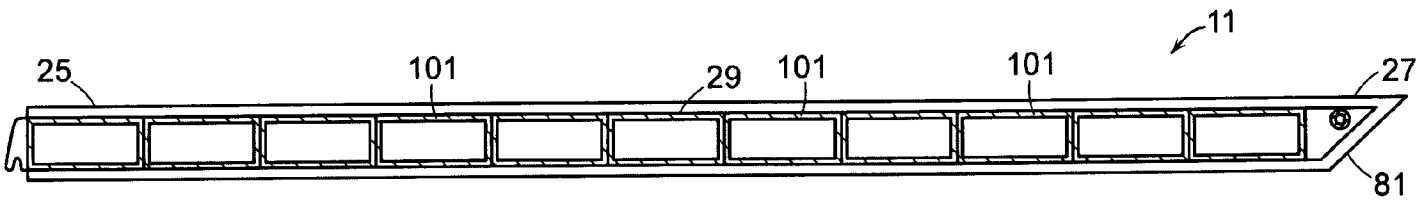
FIG. 4B depicts a cross-sectional side view of the ramp of FIG. 3A taken at IV—IV.
Figure 4C:
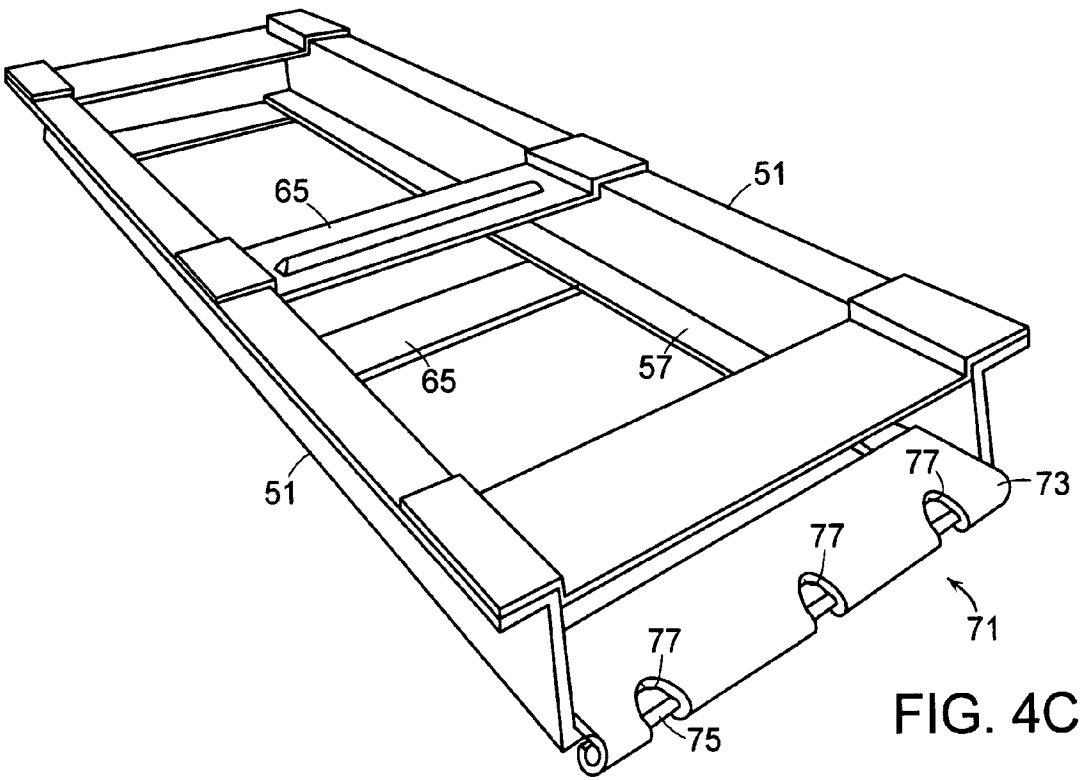
FIG. 4C illustrates a perspective view of the ramp support members of FIG. 4A.

Referring to FIG. 4C, a lower ramp hanger 71 includes a pin support member 53 and a pin 75. Pin support member 73 is rigidly attached to a first end to the lower portions 57 of ramp support members 51. A second end of the pin support member 73 circumscribes pin 75 to provide support to the pin 75. A plurality of hanger slots 77 are formed in the pin support member 73 just aft of the pin 75. The center hanger slot 77 is provided to allow attachment of a trailer strap (not shown) to the pontoon boat when the pontoon boat is placed on a trailer.

Referring again to FIGS. 4A and 5A, ramp 11 includes a pair of side rails 81 that preferably are formed from an extruded aluminum I-beam. Each side rail 81 includes an upper rail member 83 and a lower rail member 85 joined by a web 87. The rail members 83, 85 and the web 87 form an inboard pocket 91 and an outboard pocket 93. Outboard pockets 93 are adapted to receive the rollers 69 mounted on the vertically-oriented portions 55 of the ramp support members 51. Rollers 69 allow the ramp 11 to be slidably received between the ramp support members 51 such that the ramp 11 can be moved between the stowed and extended positions.

A person of ordinary skill in the art will recognize that the cross-section of the side rails 81 could vary. Instead of having an I-shaped cross section, the rails 81 could be formed from a C-shaped cross section provided that each side rail 81 is oriented to form the outboard pocket 93 for receiving the rollers 69. Two important features of the present invention are the upper rail member 83 positioned above the rollers 69 and the lower rail member 85 positioned below the rollers 69. The rollers 69 bear the weight of the ramp 11 through the upper rail member 83. The lower rail member 85 prevents the ramp 11 from moving upward and striking the ramp support structure or the deck 17 of the pontoon boat. Since the ramp can frequently experience upward forces caused by movement of the pontoon boat across waves, the presence of the lower rail member 85 is important in reducing noise caused by movement and rattling of the ramp 11. The noise can be further reduced by using rollers 69 made from polyurethane, rubber, or other energy absorbing material.

Figure 6:
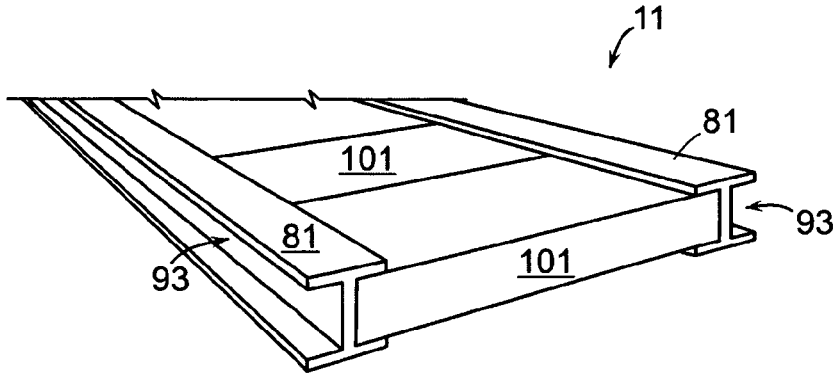
FIG. 6 depicts a cross-sectional perspective view of the stowable ramp of FIG. 1.

Referring still to FIG. 4A, and also to FIGS. 4B and 6, ramp 11 includes a plurality of modular walkway members 101 received between the inboard pockets 91 of the side rails 81. The modular walkway members 101 are preferably rectangular aluminum extrusions. When installed, the walkway members 101 collectively form the walkway surface 29 on which passengers walk as they board and exit the boat. A person of ordinary skill in the art of the invention will recognize that modular walkway members 101 could be constructed of any rigid material. As an alternative to modular members, walkway surface 29 may be formed from a single sheet of metal, hard plastic, or any other rigid material positioned on or between the side rails 81. Preferably, a non-slip material is applied to walkway surface 29 to provide traction to persons using the ramp 11.

Figure 5B:
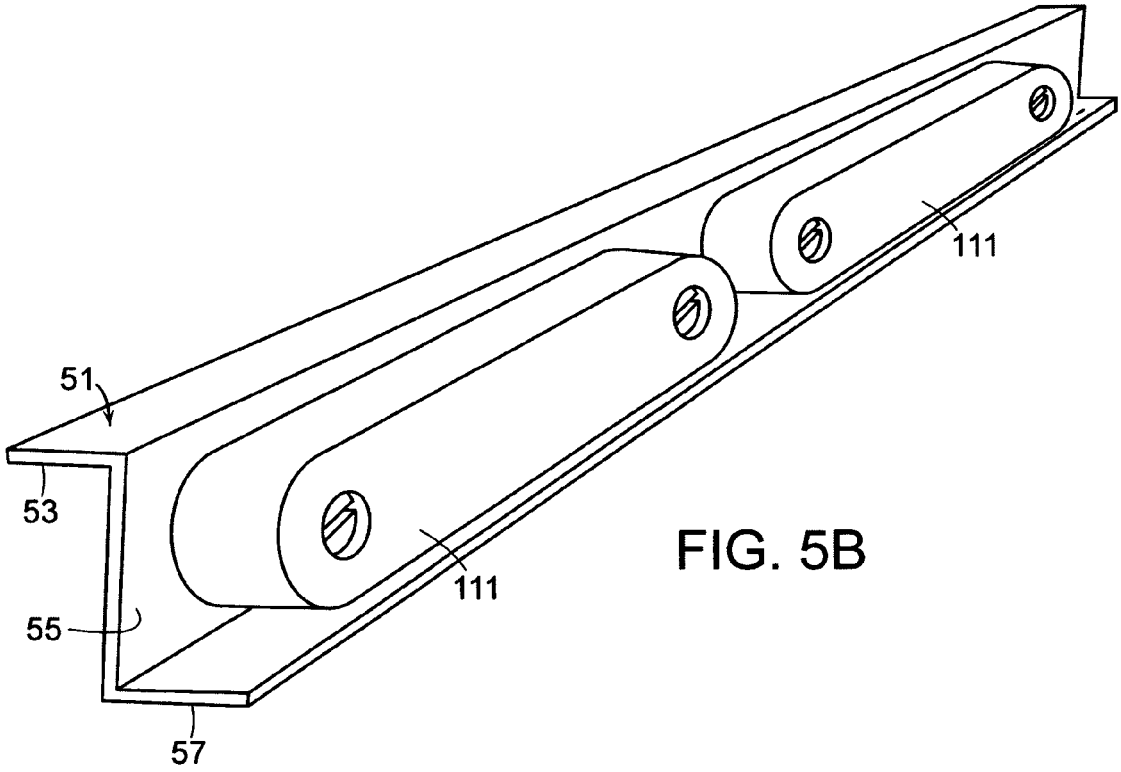
FIG. 5B illustrates a perspective view of a ramp support member having a guide bar for supporting the ramp according to an alternative embodiment of the present invention.

Referring now to FIG. 5B, an alternative to rollers 69 is illustrated. Instead of mounting rotatable roller 69 along vertically-oriented portion 55, a guide bar 111 or a plurality of guide bars could be mounted on the vertically-oriented portion 55 of the ramp support member 51. Like rollers 69, the guide bars 111 would be received by the inboard pockets 91 of the side rails 81. The guide bars 111 are made of a polyurethane or other polymer material with a low coefficient of friction to allow easy sliding of the ramp 11 on guide bars 111.

Figure 7A:
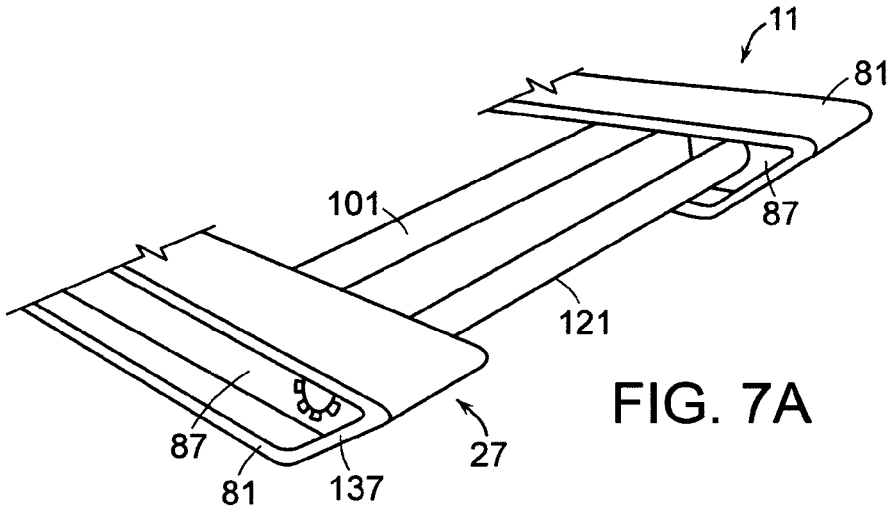
FIG. 7A illustrates a more detailed perspective view of an outboard end of the stowable ramp of FIG. 1, the stowable ramp having a handle.
Figure 7B:
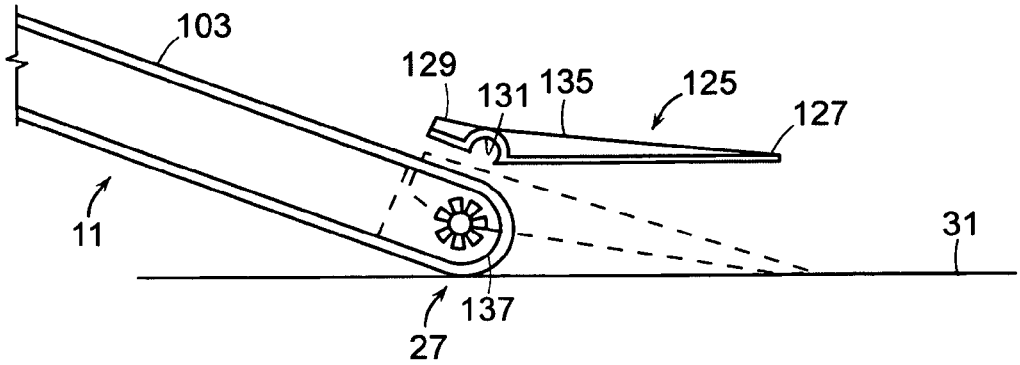
FIG. 7B depicts a side view of an outboard end of the stowable ramp of FIG. 1, the ramp being used in conjunction with a plank shoe to ease access to the ramp.

Referring to FIGS. 7A and 7B, a handle 121 is connected to ramp 11 near the outboard end 27 of the ramp 11. Preferably, the handle 121 has a circular cross section and is rigidly attached to the webs 87 of side rails 81. A plank shoe 125 having a toe 127, a heel 129, and an inclined surface 135 is provided to allow a gentle transition between walkway surface 103 and anchor surface 31. An arcuate channel 131 is provided near the heel 129 and is shaped to receive handle 121. When the ramp 11 is extended an the outboard end of the ramp 11 is placed on anchor surface 31, the plank shoe 125 is easily installed by placing the plank shoe 125 on top of the handle 121 such that handle 121 is received by the arcuate channel 131. Since the plank shoe 125 is allowed to pivotally rotate about handle 121, variations in the angle between ramp 11 and anchor surface 31 are of no consequence. This is an important feature since it is readily recognized that a pontoon boat floating on undulating waves will continually experience variations in this angle.

Plank shoe 125 is not required for boarding and exiting the boat, but it does serve an important purpose, especially for elderly passengers or handicapped passengers using wheelchairs. Because of the thickness of the modular walkway members 101, a step is created between the anchor surface 31 and the first modular walkway member 101 at the outboard end 27 of the ramp 11. The gradual, inclined surface 135 eliminates the step between the first walkway member 101 and the anchor surface 31.

Ramp 11 includes a toe cap 137 that is preferably integrally connected to the side rails 81 at the outboard end 37 of the ramp 11. In FIG. 7A, the toe cap 137 is angled, while it is rounded in FIG. 7B. The toe cap 137 could be many different shapes and sizes without affecting the overall functionality of the ramp 11.

Figure 8A:
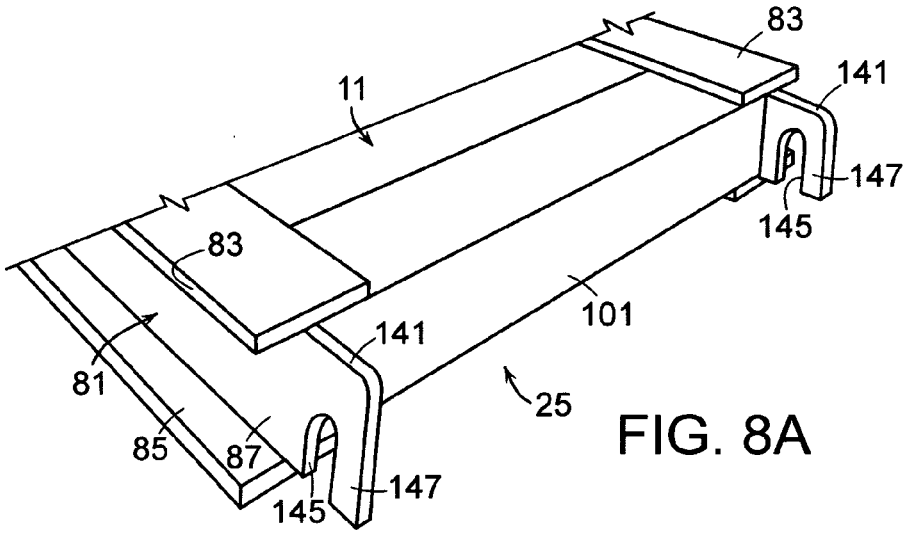
FIG. 8A illustrates a perspective view of an inboard end of the stowable ramp of FIG. 1, the stowable ramp having a pair of endcap legs.

Referring to FIG. 8A, ramp 11 includes an endcap 141 at the inboard end 25 of the ramp 11. Endcap 141 is an extension of the web 87 of side rail 81 past the upper rail member 83 and the lower rail member 85. Endcap 141 includes an inverted, U-shaped slot 145, which creates an endcap leg 147. In a preferred embodiment, the endcap 141 can be used to hang the inboard end 25 of the ramp 11 when the ramp 11 is in the extended position. The ramp 11 can be hung from the lower ramp hanger 71 illustrated in FIG. 4C. Each endcap leg 147 of the ramp 11 is received by one of the hanger slots 77. The pin 75 is received by the slot 145 formed in the endcap 141. Hanging the ramp 11 from the lower ramp hanger 71 secures the ramp 11 when in the extended position; however, the use of the lower ramp hanger 71 requires a person walking on the ramp 11 to step up from the ramp 11 to the deck 17 when boarding the boat, or to step down from the deck 17 to the ramp 11 when exiting the boat.

Figure 8B:
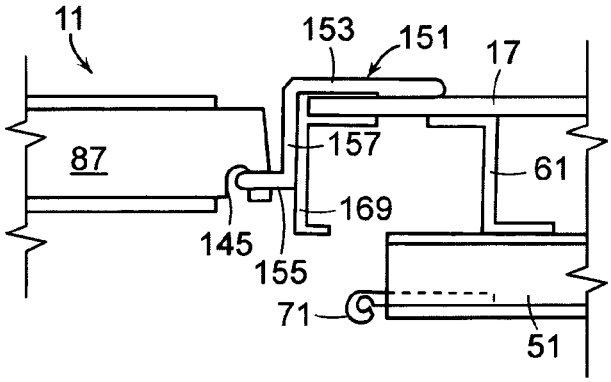
FIG. 8B depicts a side view of the inboard end of the stowable ramp of FIG. 8A, the ramp being supported by a hanger attached to the deck of the pontoon boat.
Figure 8C:
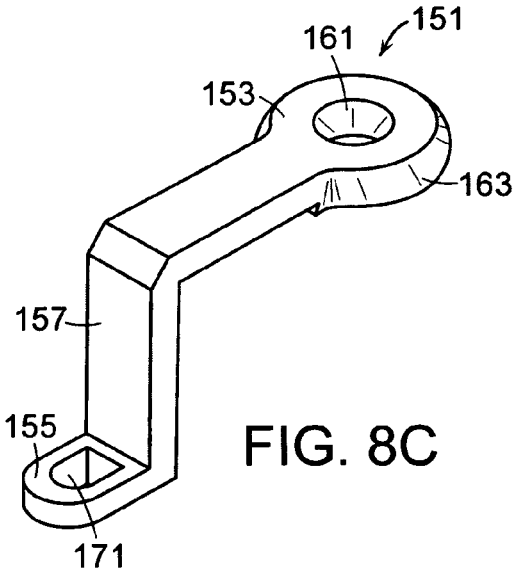
FIG. 8C illustrates a perspective view of the hanger of FIG. 8B.
Figure 8D:
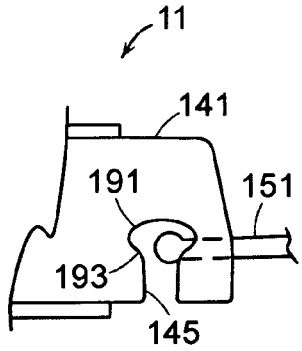
FIG. 8D depicts a side view of an inboard end of the stowable ramp of FIG. 1, the ramp having a flared slot according to an alternative embodiment of the present invention.
Figure 8E:
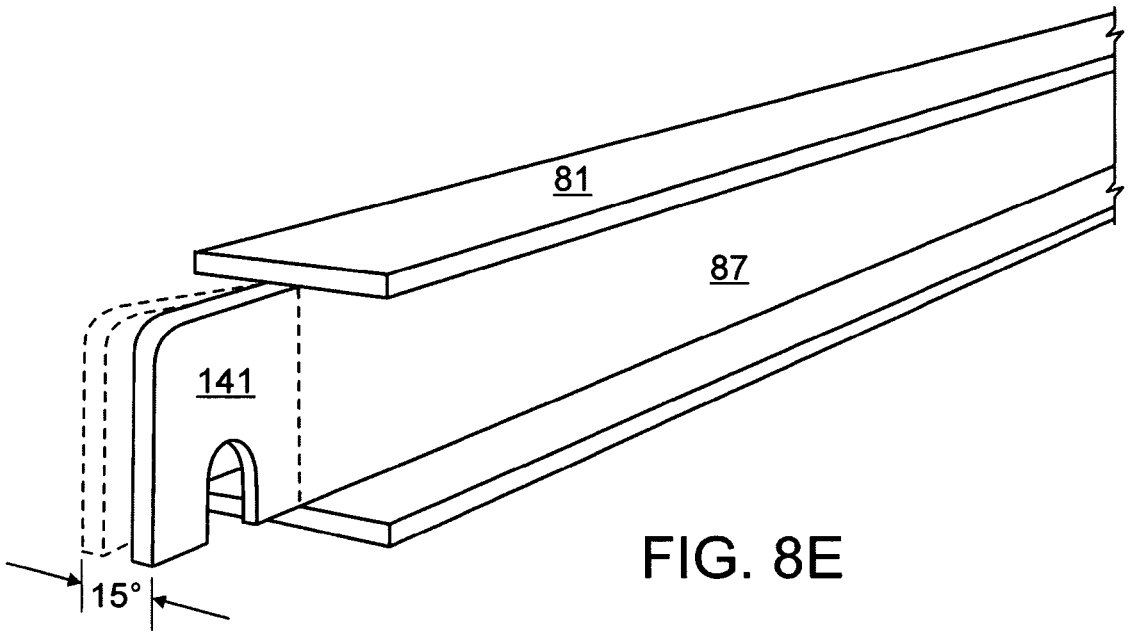
FIG. 8E illustrates a perspective view of side rail having an angled endcap according to the present invention.
Figure 8F:
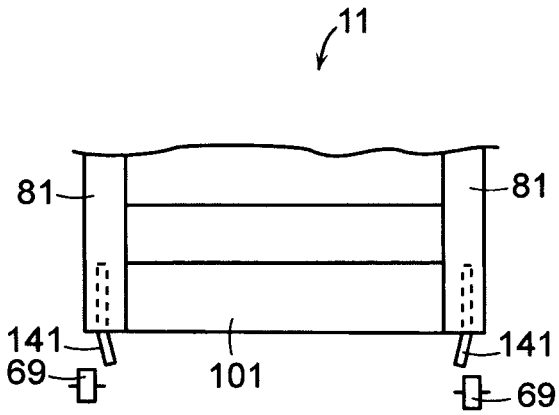
FIG. 8F depicts a top view of the side rails and angled endcaps of FIG. 8E.

Referring to FIG. 8E, the endcaps 141 of the ramp may be angled inward toward one another at approximately a 15 degree angle (i.e. 15 degrees inward from a longitudinal axis of web 87). Although it is not necessary to have angled endcaps, this feature simplifies the process of inserting the ramp 11 into the ramp support members 51. As the ramp 11 approaches the first pair of rollers 69, the angled endcaps 141 serve as a guide to properly align the ramp 11 between the rollers 69 (see FIG. 8F).

Referring to FIGS. 8B and 8C, an upper ramp hanger 151 includes an upper portion 153 and a lower portion 155 joined by a connecting portion 157. The upper portion 153 of the upper ramp hanger 151 is a substantially planar extension having an aperture 161 for receiving a fastener (not shown) to attach the ramp hanger 151 to the deck 17. Tapered side surfaces 163 allow the upper portion 153 to be installed on the deck 17 without creating a tripping hazard for persons boarding or exiting the boat. The connecting portion 157 is integrally attached to the upper portion 153 at a substantially right angle. When the upper ramp hanger 151 is installed, the connecting portion 157 matingly abuts a perimeter cap 169 attached to the deck. Lower portion 155 is integrally attached to the connecting portion 157 at a substantially right angle and extends generally outward from the perimeter cap 169 of the deck 17. Lower portion 155 is substantially planar and includes a slot 171. Preferably, two upper ramp hangers 151 are mounted to the deck 17 in each location that the ramp 11 is to be hung.

As explained previously, when the ramp 11 is extended from the pontoon boat, the ramp 11 can be hung from the lower ramp hanger 71, which creates a step between the ramp and the deck. Alternatively, the ramp 11 can be hung from the upper ramp hanger 151 to insure a flush (i.e. non-stepped) transition between the walkway surface 29 and the deck 17. The ramp 11 is hung by inserting each endcap leg 147 of the ramp 11 into the slot 171 of one of the upper ramp hangers 151. With each endcap leg 147 received by one of the slots 171, the ramp 11 is securely attached to the deck such that a person could board or exit the boat using the ramp 11.

It is important to note that the upper ramp hangers 151 or lower ramp hangers 71 could be positioned on any side of the pontoon boat. Since many pontoon boats have access doors on the bow, port side, and starboard side of the boat, the ramp hangers 71, 151 could be positioned near these doors. Since the ramp is designed to be lightweight, it can be easily removed from the ramp support members 51 and selectively hung from ramp hangers 71, 151 on any side of the boat. In a preferred embodiment, the upper ramp hangers 151 are used since these hangers provide a flush transition between the deck 17 and the walkway surface 29.

Referring to FIG. 8D, the U-shaped slot 145 of each endcap 141 could contain a flared portion 191 having a shoulder 193. The flared portion 191 provides additional resistance to movement when the ramp 11 is hung on one of the ramp hangers 71, 151. Without a flared portion 191, the U-shaped slot 145 and ramp hanger would prevent the inboard end of the ramp from moving inboard, outboard, or downward relative to the boat. Adding the flared portion 191 to the slot 145 prevents upward forces (caused by movement of the boat or a non-stationary anchor surface) on the ramp 11 from causing the ramp to become disengaged from the ramp hangers 71, 151. The shoulder 193 would engage a portion of the ramp hanger 71, 151 if an upward force were applied to the ramp 11, thereby preventing the ramp from slipping off of the ramp hanger 71, 151.

Figure 9A:
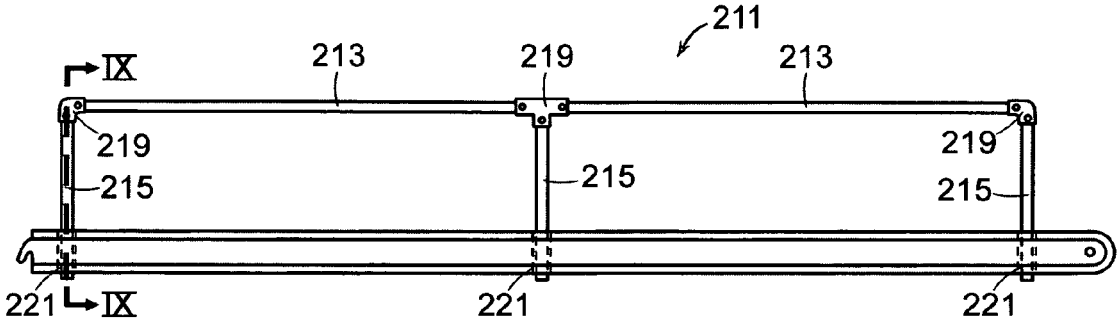
FIG. 9A illustrates a side view of a collapsible railing installed on the stowable ramp of FIG. 1, the collapsible railing being shown in an assembled position and having at least one hand railing pivotally attached to a plurality of support legs.
Figure 9B:
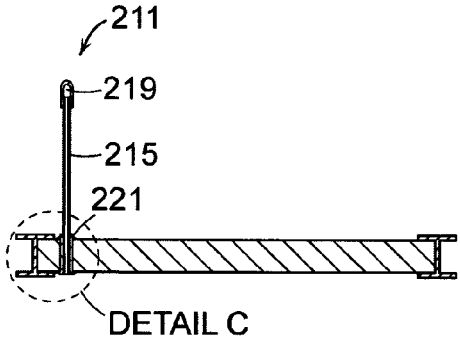
FIG. 9B depicts a cross-sectional front view of the collapsible railing and stowable ramp of FIG. 9A taken at IX—IX.
Figure 9D:
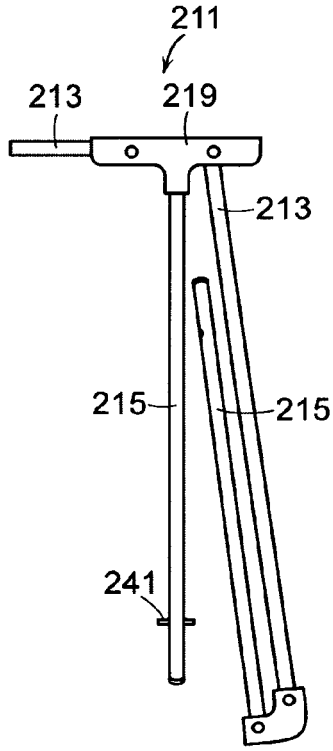
FIG. 9D depicts a side view of the collapsible railing of FIG. 9A being shown in a partially collapsible position.
Figure 9C:
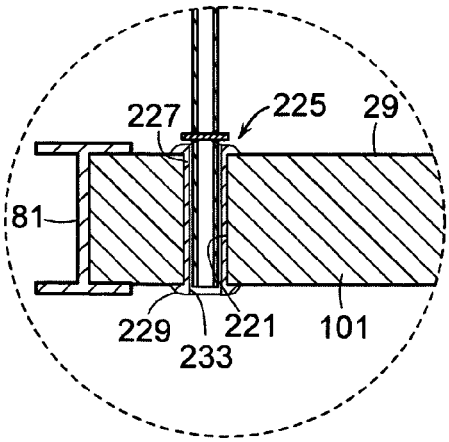
FIG. 9C illustrates an enlarged front view of the stowable ramp of FIG. 9B taken at Detail C.

Referring to FIGS. 9A–9D, a collapsible railing 211 includes a handrail 213 pivotally connected to a plurality of support legs 215. Preferably, a plurality of rail brackets 219 facilitate the pivotal connection between the handrails 213 and support legs 215. The rail brackets 219 may be T-shaped if joining two handrails 213 and one support leg 215, or may be L-shaped if joining one handrail 213 and one support leg 215. The support legs 215 and handrail 213 are pivotal between an assembled position (shown in FIG. 9A) and a collapsed position (a partially collapsed position is shown in FIG. 9D). A plurality of holes 221 are provided in the walkway members 101, and each hole is preferably lined with an insert 225 having a sleeve 227 terminating on each end in a rounded cap 229. Each rounded cap 229 includes an aperture 233 having a diameter that is slightly larger than the diameter of the support legs 215.

When the collapsible railing 211 is placed in the assembled position, each support leg 215 is received by one of the sleeves 227. A detent 241 is disposed on each support leg 215 and abuts the walkway surface 29 when the support leg 215 is fully inserted into the sleeve 227. The detent 241 provides a stopping mechanism by which the support leg 215 is prevented from slipping through the sleeve 227. In the collapsed position, each support leg 215 is removed from the sleeve 227, and the support legs 215 and handrails 213 are pivoted until adjacent one another as shown in FIG. 9D. In the collapsed position, the collapsible railing 211 is easily stored on the pontoon boat.

While the structural portions of the ramp assembly (i.e. the ramp support members 51, the ramp 11, and the ramp hangers 71, 151) are preferably made from aluminum, these parts could be made from any metal or rigid polymer material. Aluminum is preferred because of its resistance to corrosion and high strength-to-weight ratio.

The ramp assembly provided by the present invention presents several advantages over existing ramps. The ramp is selectively positionable on any side of the pontoon boat, which increases the options available for docking the pontoon boat. If a beach landing is preferred, the ramp allows passengers to board or exit via the bow of the boat. If the pontoon boat is pulled alongside another boat, a boat dock, or jetty, the ramp allows access by either the port or starboard sides. Because the ramp is lightweight, it is easily positionable on any side of the boat.

The ramp hangers of the present invention contribute to the multi-position function of the ramp. The use of upper ramp hangers attached directly to the deck of the boat provides a smooth transition between the walkway surface of the ramp and the deck of the boat. A flared slot in the endcap of the ramp allows the ramp to lockingly engage the ramp hangers, making it much more difficult for the ramp to become inadvertently disengaged from the ramp hangers.

Another advantage is provided by the low profile and lightweight design of the ramp assembly. Since the ramp does not incorporate a complicated hoisting system or heavy sliding mechanisms, the ramp is able to be compactly stored beneath the deck of the boat between the two pontoons. The rollers are conveniently placed in line with the ramp, as opposed to below the ramp, which minimizes the amount of ramp-related structure extending below the boat. This is important since it prevents the ramp from creating additional drag as the boat moves through the water. The placement of the rollers between an upper rail member and lower rail member is also important because it prevents excessive bouncing or other movement by the ramp within the ramp support members. Contact between the lower rail member and the roller prevents the ramp from "jumping" into the deck or deck support structure. Excessive side-to-side movement is prevented by the rollers' contact with the web of the side rails. These limitations on the movement of the ramp minimize noise while the boat is underway or is experiencing motion from large waves.

Other advantages are provided by the plank shoe and the collapsible railing. Both of these accessories increase the safety of the ramp. The plank shoe provides a smooth transition between the walkway surface and anchor surface, which will minimize the risk of a person tripping wile stepping onto the ramp. The plank shoe also provides easier access for handicapped persons, especially those using wheelchairs. The collapsible railing provides a secure hand railing for passengers using the ramp. When not in use, the collapsible railing can be easily stored on the boat.

It should be apparent from the foregoing specification that an invention having significant advantages has been provided. While the invention is shown in only a few of its forms, it is not just limited but is susceptible to various changes and modifications without departing from the spirit thereof.

I claim:

1. A ramp assembly for a pontoon boat having a deck supported by at least two pontoons, the ramp assembly comprising:

a pair of ramp support members having a substantially vertically-oriented portion and an upper portion, the ramp support members being attached to the pontoon boat beneath the deck of the pontoon boat and between the at least two pontoons;

at least one of a roller and a guide bar attached to the substantially vertically-oriented portion of each ramp support member;

a ramp having a pair of side rails, one side rail being positioned on each side of the walkway, the side rails each having an upper rail member and a lower rail member joined by a web; and wherein the ramp is received between the ramp support members such that the at least one of the roller and the guide bar is positioned between the upper rail member and the lower rail member.

2. A ramp assembly according to claim 1, wherein the ramp support members are z-shaped extrusions.

3. A ramp assembly according to claim 1, wherein:

the side rails of the ramp have an I-shaped cross-section, thereby forming an inboard pocket and an outboard pocket on each side of the web; and the at least one of the roller and the guide bar is received by the outboard pocket of the side rail.

4. A ramp assembly according to claim 1, wherein:

the side rails of the ramp have an I-shaped cross-section, thereby forming an inboard pocket and an outboard pocket on each side of the web; and the inboard pockets of the side rails receive a plurality of modular walkway members.

5. A ramp assembly according to claim 4, wherein the walkway members are extruded rectangular tubing.

6. A ramp assembly according to claim 1 further comprising:

an endcap leg disposed at an inboard end of the ramp; and a lower ramp hanger connected to the ramp support members, the lower ramp hanger having a hanger slot for receiving the endcap leg of the ramp when the ramp is in an extended position.

7. A ramp assembly according to claim 1 further comprising:

an endcap leg disposed at an inboard end of the ramp;

an upper ramp hanger connected to the deck, the upper ramp hanger having a hanger slot for receiving the endcap leg of the ramp when the ramp is in an extended position; and wherein a walkway surface of the ramp is substantially flush with an upper surface of the deck when the endcap leg engages the hanger slot.

8. A ramp assembly according to claim 1 further comprising:

a handle disposed at an outboard end of the ramp; and a plank shoe pivotally connected to the handle, the plank shoe having an inclined surface for providing a smooth transition between a walkway surface of the ramp and an anchor surface on which the outboard end of the ramp rests when the ramp is in an extended position.

9. A ramp assembly according to claim 1 further comprising:

at least one hand railing;

a plurality of support legs pivotally connected to the hand railing;

a plurality of railing holes disposed in the ramp;

wherein in an assembled position, a portion of the support legs are received by the railing holes and the hand railing is substantially parallel to the walkway surface of the ramp; and wherein in a collapsed position, the support legs are pivoted such to place the support legs adjacent to the hand railing for storage.

10. A ramp assembly for a pontoon boat having a deck supported by at least two pontoons, the ramp assembly comprising:

a pair of ramp support members having a substantially vertically-oriented portion and an upper portion, the ramp support members being attached to the pontoon boat beneath the deck of the pontoon boat and between the at least two pontoons;

at least one of a roller and a guide bar attached to the substantially vertically-oriented portion of each ramp support member;

a removable ramp having a pair of side rails, one side rail being positioned on each side of a walkway, the side rails each having an upper rail member and a lower rail member joined by a web;

a first deck hanger positioned at the bow of the pontoon boat;

a second deck hanger positioned at one of the port side and starboard side of the pontoon boat;

wherein the ramp is received between the ramp support members in a stowed position such that the at least one of the roller and the guide bar is positioned between the upper rail member and the lower rail member; and wherein the ramp is adapted to be received by one of the first and second ramp hangers in an extended position, thereby providing the walkway for one of the bow, port side, and starboard side of the pontoon boat.

11. A ramp assembly according to claim 10, wherein:

the side rails of the ramp having an I-shaped cross-section, thereby forming an inboard pocket and an outboard pocket on each side of the web; and the at least one of the rollers and the guide bar is received by the outboard pocket of the side rail.

12. A ramp assembly according to claim 10, wherein:

the side rails of the ramp have an I-shaped cross-section, thereby forming an inboard pocket and an outboard pocket on each side of the web;

the at least one of the roller and the guide bar is received by the outboard pocket of the side rail; and the inboard pockets of the side rails receive a plurality of modular walkway members.

13. A ramp according to claim 12, wherein the walkway members are extruded tubing having a rectangular cross-section.

14. A ramp assembly according to claim 10 further comprising:

an endcap leg disposed at an inboard end of the ramp; and wherein the endcap leg is received by one of the first hanger and the second hanger when the ramp is placed in the extended position.

15. A ramp assembly according to claim 10, wherein the first and second ramp hangers are mounted to the deck such that the ramp is capable of being positioned in the extended position with the walkway substantially flush with the deck.

16. A ramp assembly according to claim 10 further comprising:

an endcap leg disposed at an inboard end of the ramp;

wherein the endcap leg is received by one of the first hanger and the second hanger when the ramp is placed in the extended position; and wherein the first and second ramp hangers are mounted to the deck such that the ramp is capable of being positioned in the extended position with the walkway substantially flush with the deck.

17. A ramp assembly according to claim 10 further comprising:

at least one hand railing;

a plurality of support legs pivotally connected to the hand railing;

a plurality of railing holes disposed in the ramp;

wherein in an assembled position, a portion of the support legs are received by the railing holes and the hand railing is substantially parallel to the walkway of the ramp; and wherein in a collapsed position, the support legs are pivoted such to place the support legs adjacent to the hand railing for storage.

18. A ramp assembly according to claim 10 further comprising:

a handle disposed near an outboard end of the ramp; and a plank shoe pivotally connected to the handle, the plank shoe having an inclined surface providing a smooth transition between the walkway surface of the ramp and an anchor surface on which the outboard end of the ramp rests when the ramp is in the extended position.

19. A ramp assembly for a pontoon boat having a deck supported by at least two pontoons, the ramp assembly comprising:

a pair of ramp support members having a substantially vertically-oriented portion and an upper portion, the ramp support members being attached to the pontoon boat beneath the deck of the pontoon boat and between the at least two pontoons;

a pair of guide bars attached to the substantially vertically-oriented portion of each ramp support member;

a ramp having a pair of side rails, one side rail being positioned on each side of the walkway, the side rails each having an upper rail member and a lower rail member joined by a web; and wherein the ramp is received between the ramp support members such that the pair of guide bars is positioned between the upper rail member and the lower rail member of each side rail.

20. A ramp assembly according to claim 19, wherein the ramp support members are z-shaped extrusions.

* * * * *